US007425035B2

(12) United States Patent
Richardson et al.

(10) Patent No.: US 7,425,035 B2
(45) Date of Patent: Sep. 16, 2008

(54) GARDENING CHAIR

(76) Inventors: Charlene F. Richardson, 4803 Neil St., Alexandria, LA (US) 71302; Michael A. Richardson, 4803 Neil St., Alexandria, LA (US) 71302; Glenn A. Stewart, 2308 Broadway Ave., Alexandria, LA (US) 71302

( * ) Notice: Subject to any disclaimer, the term of this patent is extended or adjusted under 35 U.S.C. 154(b) by 0 days.

(21) Appl. No.: 11/705,311

(22) Filed: Feb. 12, 2007

(65) Prior Publication Data

US 2007/0138856 A1 Jun. 21, 2007

Related U.S. Application Data

(62) Division of application No. 10/434,705, filed on May 9, 2003, now Pat. No. 7,178,868.

(51) Int. Cl.
*B60N 2/24* (2006.01)

(52) U.S. Cl. ..... 297/195.11

(58) Field of Classification Search ..... 297/195.11, 297/445.1, 449.1, 452.18, 447.4, 354.13, 297/423.11, 195.1
See application file for complete search history.

(56) References Cited

U.S. PATENT DOCUMENTS

| | | | | | |
|---|---|---|---|---|---|
| 4,057,214 | A * | 11/1977 | Harder, Jr. | ..... | 248/634 |
| 5,519,902 | A * | 5/1996 | Meade | ..... | 5/38 |
| 5,524,964 | A * | 6/1996 | Weimersheimer | ..... | 297/256.12 |
| 5,868,461 | A * | 2/1999 | Brotherston | ..... | 297/84 |
| 5,882,083 | A * | 3/1999 | Robinson | ..... | 297/440.2 |
| 6,595,590 | B2 * | 7/2003 | Bottoms | ..... | 297/423.11 |
| 6,698,831 | B2 * | 3/2004 | Lloyd | ..... | 297/195.11 |

* cited by examiner

*Primary Examiner*—Milton Nelson, Jr.
(74) *Attorney, Agent, or Firm*—Kenneth D. Baugh

(57) ABSTRACT

A gardening chair 10 is provided for supporting a user 12 thereon. The gardening chair 10 is provided with a base support member 14, and a seat 52 aligned with and coupled to upper portions of the base support member for supporting a user's lower body thereon. A diagonally extending chest support member 72 is provided for supporting a user's chest 12 and upper body thereon. An L-shaped tensioning arm 152 and an elastic band 156 are coupled to one end of intermediate portions of the diagonally extending chest support member 72 and the base support member 14 to support the member for movement to a plurality of predetermined diagonal positions.

4 Claims, 3 Drawing Sheets

GARDENING CHAIR

TECHNICAL FIELD

This application is a divisional application of my U.S. patent application Ser. No. 10/434,705 filed on May 9, 2003 now U.S. Pat. No. 7,178,868.

This invention relates to a chair and more particularly to a chair to be used in gardening. For some time now gardening has been a very popular activity. The practicality of gardening activities is increasingly becoming part of the hobbies and leisure activities of an ever increasing number of people. Although these activities are popular they can be somewhat tedious particularly such essential parts of the gardening process as weed removal and planting. Removal of weeds of course improves the appearance of a garden or landscaped area and of course eliminates those nuisance plants that tend to destroy the valuable plants that are planted to grow in the same ground. The most effective method of weeding and planting an area is of course by hand. Normally however this can take a significant amount of time, in somewhat awkward work positions that place a great deal of physical strain on many parts of the body. Accordingly it is desirable to provide an apparatus that can minimize the physical strain associated with the weeding and planting process so that a more comfortable and enjoyable physical experience is achievable.

BACKGROUND OF THE ART

Attempts have been made to provide garden chairs that are desirable which can also satisfy the users need for comfort while outdoors. One such chair is disclosed in U.S. Pat. No. 4,556,224. This chair is a garden chair including a back rest, a seat and a cross frame defined by a first and second pair of support braces rotatably connected together through a first axle. The first pair of support braces are also rotatably connected to the front of the seat through a second axle and the rear of the seat is rotatably connected to the back rest through a third axle. An arm provided with a longitudinal slot connects the second pair of braces to the back rest, with the third axle passing through the longitudinal slot. A free end of the arm and the back rest are engabable in a plurality of positions to permit vertical adjustment of the seat.

Another arrangement is disclosed in U.S. Pat. No. 5,397,168. This seating apparatus includes a frame, a member supported by the frame for movement relative thereto, a ratchet mechanism for affording movement of the member relative to the frame in a first direction from a first extreme position through a range of positions to a second extreme position and for preventing movement of the member relative to the frame in a second direction opposite to the first direction. The ratchet mechanism includes a ratchet and a one-piece pawl including a first portion engageble with the ratchet, a resilient portion for bracing the pawl into engagement with the ratchet, and a release mechanism for completely disengaging the ratchet and the pawl when the member is moved into the second extreme position.

These arrangements are suitable for the purpose intended. That is to provide a suitable adjustable seat to be used outdoors. However these seats are designed to provide comfort for a user while engaged in leisurely and restful activities. They are not designed for and cannot be readily useable in a working environment such as for gardening. They do not provide structures that will ease the physical strain on the body while engaged in gardening activities. Such a gardening chair is desirable.

DISCLOSURE OF THE INVENTION

A gardening chair for supporting a user thereon in accordance with the principles of this invention is provided with a base support member, and a seating means aligned with and coupled to upper portions of the base support member for supporting a user's lower body thereon. A diagonally extending support member is provided for supporting a user's chest and upper body thereon. The gardening chair is further provided with a means for supporting the diagonally extending support member for movement to a plurality of predetermined diagonal positions and for stopping the diagonally extending support member in a predetermined lowermost diagonal position. The means for supporting the diagonally extending support member is coupled between the diagonally extending support member and the base support member.

BRIEF DESCRIPTION OF THE INVENTION

The details of the invention will be described in connection with the accompanying drawing in which.

BEST MODE FOR CARRYING OUT THE INVENTION

Figure 1:
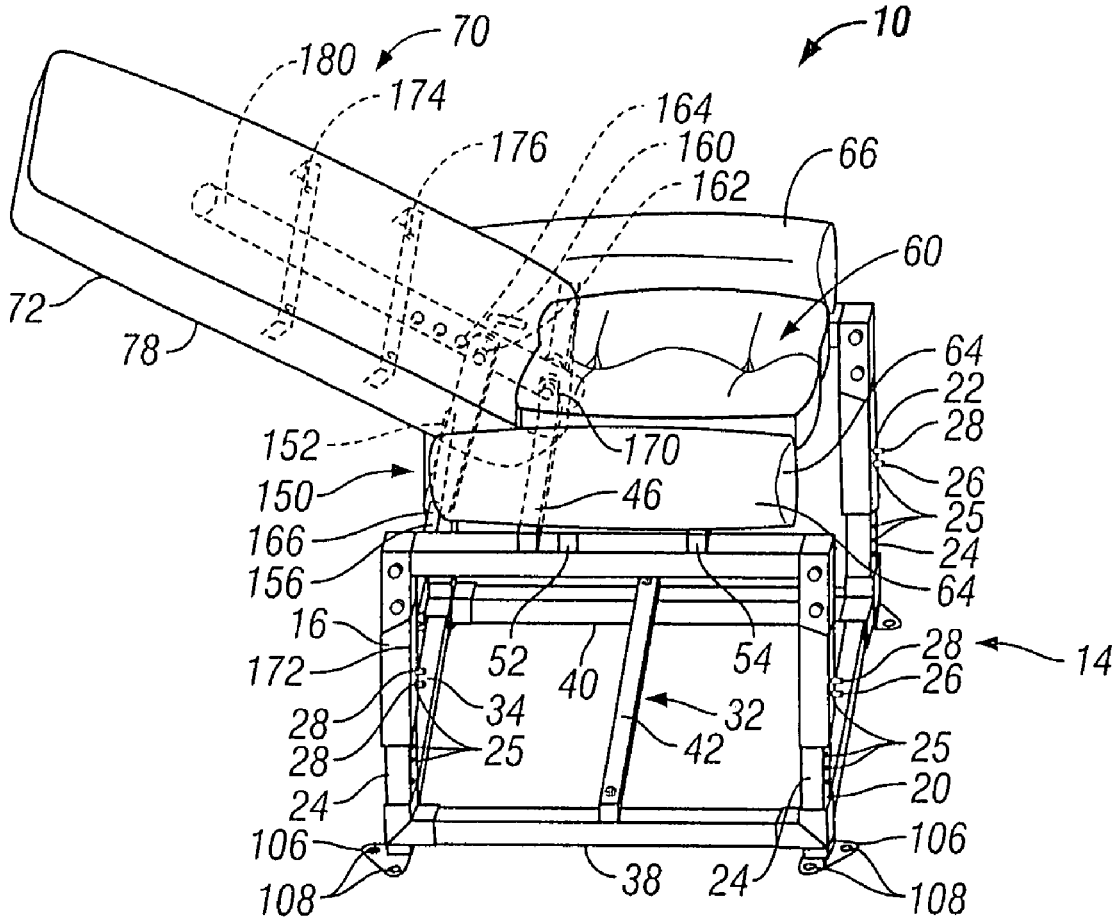
FIG. 1 is a perspective view illustrating a gardening chair in accordance with the principles of the invention.
Figure 2:
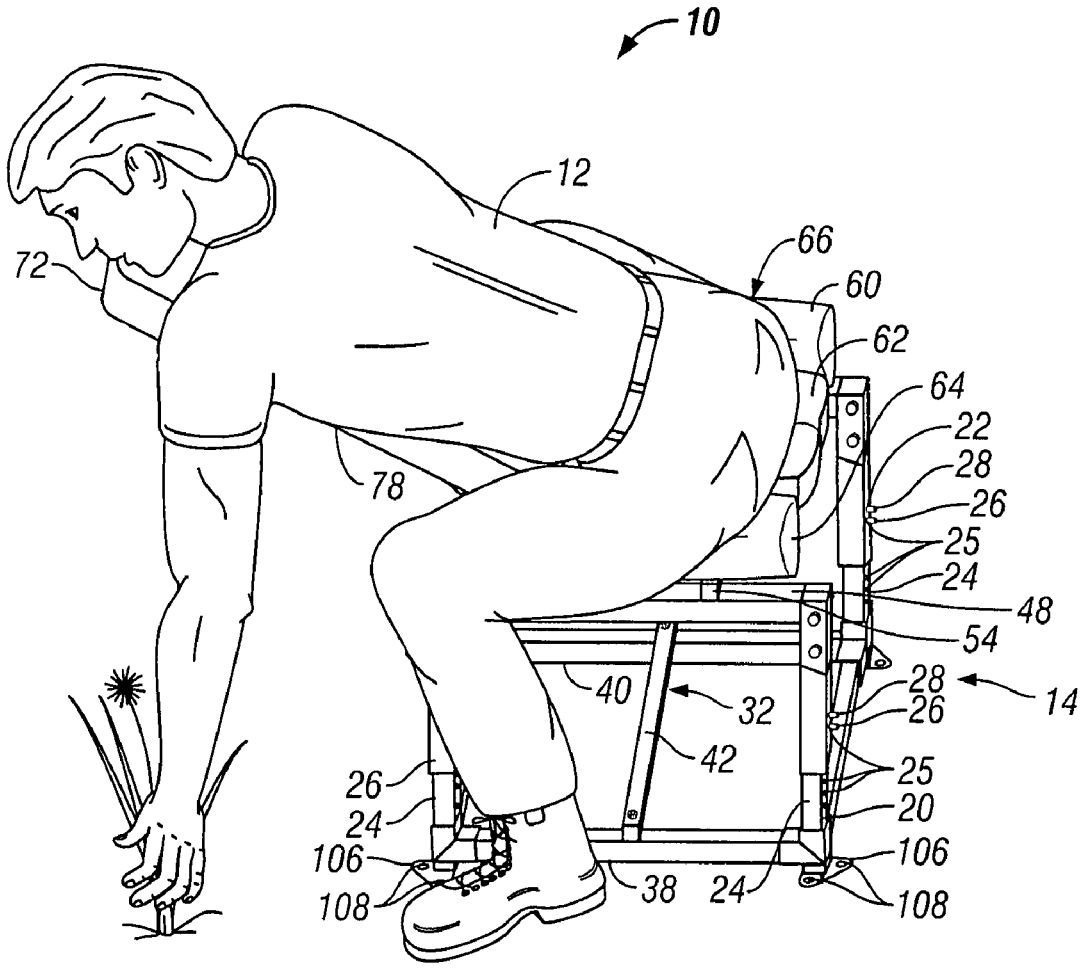
FIG. 2 is another perspective view illustrating a gardening chair with a user resting thereon in accordance with the principles of the invention.
Figure 3:
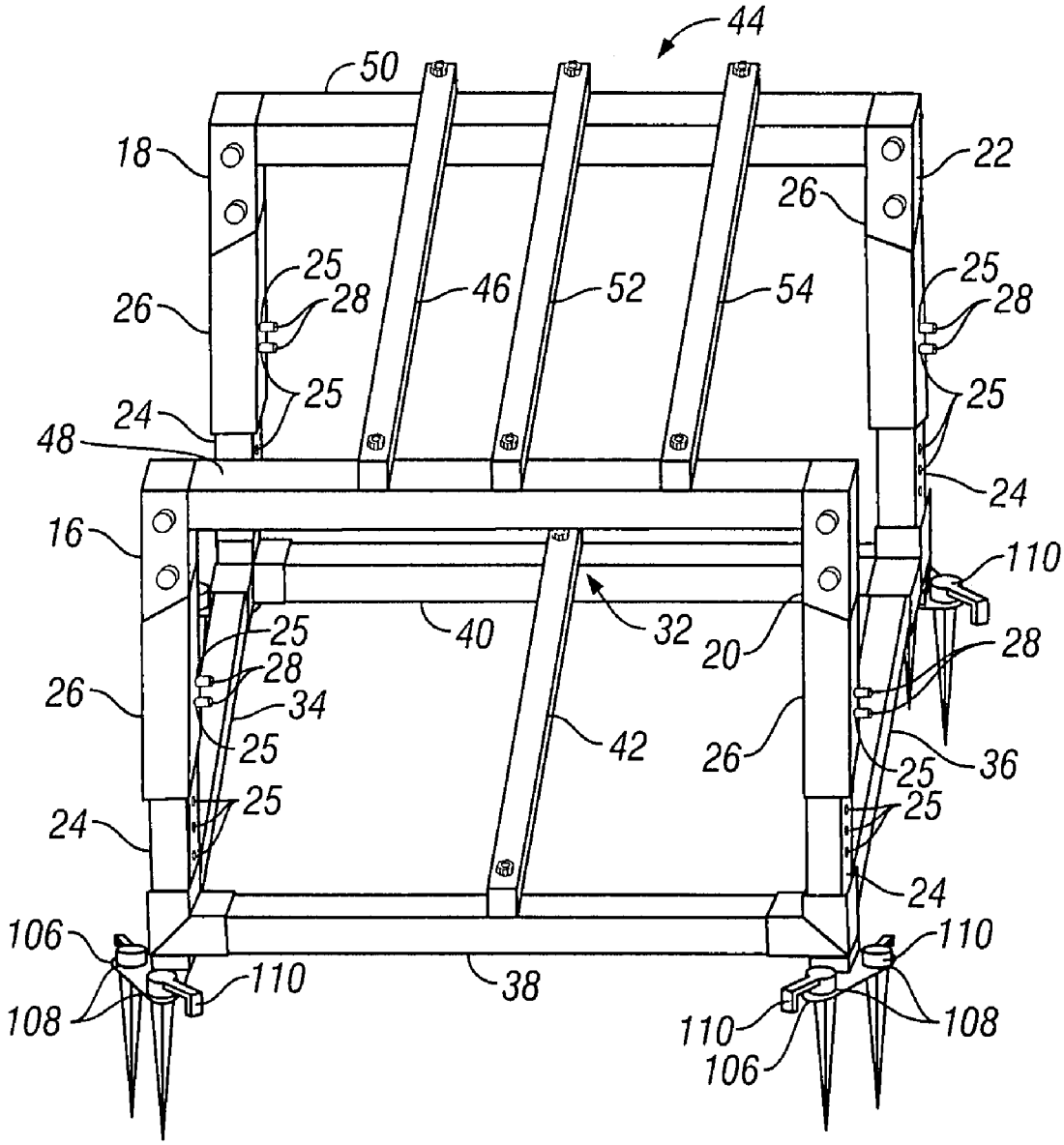
FIG. 3 is perspective view illustrating portions of a base support member of the gardening chair in accordance with the principles of the invention.

Referring to FIGS. 1, 2 and 3 a gardening chair, generally designated by the numeral, 10 is provided to support a user 12 (FIG. 2) thereon while engaged in gardening activities. The chair 10 includes a base support member, generally designated, by the numeral 14.

The base support member 14 is provided with a pair of spaced front vertically extending legs 16 and 18, and a pair of spaced vertically extending rear legs 20 and 22. The vertically extending legs 16, 18, 20 and 22 are each provided with a lower member 24 and upper member 26. The lower member 24 is mounted for slidable movement inside the upper member 26. The lower member 24 is provided with spring biased abutments 25, and the upper member 26 is provided with apertures 28 formed therein. The abutments 25 are provided to engage and rest in the aligned apertures 28 in the upper member 26. This allows the legs 16, 18 20 and 22 to be lengthened or shortened in a well known manner as may be desired by a user. This may become desirable because of the irregularity of the terrain or even the size of the plants or weeds in a gardening work area. A rectangular shaped lower support member, generally designated, by the numeral 32 is provided to stabilize lower portions of the base support member 14. The lower support member 32 is provided with horizontally extending support members 34,36, 38 and 40. The members 34, 36 38 and 40 couple the legs 16, 18, 20 and 22 together in a rectangular configuration. The front legs 16 and 18 are coupled to each other by the horizontally extending support member 34 at lowermost portions thereof. The rear legs 20 and 22 are coupled together at a lowermost portion thereof by the horizontally extending member 36. The front leg 16 and the rear leg 20 are coupled together at lowermost portions thereof by the horizontally extending member 38 and the front leg 18 and the rear leg 22 are coupled together by the horizontally extending member 40. The lower support member 32 of the base support member 14 is also provided with an intermediate horizontally extending support member 42 which is coupled between intermediate portions of the horizontally extending members 38 and 40.

The base support member 14 is also provided with an upper support member, generally designated, by the numeral 44. The upper support member is provided with horizontally extending members 46, 48 and 50 (FIG. 3). The horizontally extending support member 46 of the upper support member is coupled between the front legs 16 and 18 at uppermost portions thereof. The horizontally extending member 40 couples the front leg 16 and rear leg 20 together at uppermost portions thereof and the front leg 18 and rear leg 22 are coupled together at uppermost portions thereof by the horizontally extending member 50.

The base support member 14 is also provided with a pair of adjacently aligned spaced horizontally extending seat support members 52 and 54 which are coupled between the horizontally extending members 48 and 50 at intermediate portions thereof.

The chair 10 is also provided with a seating apparatus, generally designated, by the numeral 60. The seating apparatus 60 is provided with a center rectangle shaped padded seating member 62 and a pair of adjacently aligned elongated shaped padded seating members 64 and 66. The center seating member 62 of the seating apparatus 60 is supported and coupled to the horizontally extending seat support members 52 and 54 on the upper support member 44 of the base support member 14. The elongated padded seating members 64 and 66 are adjacently aligned on opposite sides of the center seating member 62 around one of the horizontally extending members 48 and 50 respectively.

The chair 10 is also provided with a chest support member, generally designated, by the numeral 70. The chest support member 70 provides support to the chest of a user 12 of the chair 10. The chest support member 70 is provided with a planar shaped chest cushion 72.

The chest support member 70 is further provided with an elastic resistance apparatus, generally designated, by the numeral 150. The elastic resistance apparatus 150 provides an upward biased tension on the chest cushion 72 which allows it to be maintained in predetermined desired diagonal positions.

The apparatus 150 is provided with an L-shaped tensioning arm 152, and an elastic band 156. The tensioning arm 152 is coupled at one end 160 thereof to an intermediate portion of a lower portion 162 of chest cushion 72 by a coupling member 164.

Another end 166 of the tensioning arm which is supported under the seat is coupled to one end 168 of the elastic band 156 by a coupling member 170. The elastic band 156 is then coupled at an end 172 to an intermediate portion of the horizontally extending bar 34 which extends between the fronts leg 16 and 18 of the base support member 12. The elastic resistance support apparatus 150 determines the degree of incline of the chest cushion 72 to allow a user to lean over a designated work area while also helping to assist a user to move downwardly by the user's weight on the cushion 72 and move upward by a gentle push upward to straighten up. The elastic support apparatus may also for example be configured with a pair of tensioning arms and elastic bands if more support is desirable.

The chest cushion 72 is provided with a pair of support brackets 174 and 176 (shown in dotted lines) which are mounted to intermediate portions of an under side 78 of the cushion 72. The chest support member 70 is also provided with an elongated support member 180 which is coupled to the brackets 174 and 176. The elongated support member 180 is provided to engage the horizontally extending member 46 on the upper support member 44 to keep the chest cushion 72 from being moved downwardly beyond a predetermined diagonal position.

The chair 10 is also provided with rectangular shaped support members 106 which are coupled to the bottom of each one of the legs 16, 18, 20 and 22 of the base support member 12. The rectangular shaped support members 106 are provided with a plurality of apertures 108. The apertures 108 are provided to receive a ground engaging spike 110 which when inserted through the aperture into the ground locks the chair in place to the ground. The support members may also be fitted with wheels (not shown) and a stop mechanism (not shown) to allow the chair to be easily moved from one location to another and then locked in the desired location.

When in use the user 12 of the chair 10 is seated thereon so the chest of the user engages the cushion in a manner so the arms and hand of the user hang over the cushion and can move freely to function in the work area. This gives the user 12 support to the chest, shoulders and neck while being in a forward inclined position thereby taking the stress and strain off the lower back normally caused from having to lift up and down while gardening.

It should be understood that the invention described herein can be used in other work environments without departing from the spirit of the invention as defined in the claim.

It should be further understood that various changes and modifications can be made without departing from the spirit of the invention as defined in the claim.

What is claimed is:

1. A gardening chair for supporting a user thereon including:

a first pair of spaced vertically extending leg members;

a second pair of vertically extending leg members spaced from and aligned with the first pair of vertically extending leg members;

an upper support member which includes a first horizontally extending member coupled between the first pair of leg members, a second horizontally extending member coupled between a first one of the first pair of leg members and a first one of the second pair of leg members, a third horizontally extending member coupled between a second one of the first pair of leg members and a second one of the second pair of leg members, and a pair of spaced horizontally extending members coupled between the second and third horizontally extending members at intermediate portions thereof;

a lower support member aligned with and coupled to lowermost portions of the first and second pair of leg members which includes a fourth horizontally extending member coupled between the first pair of leg members, a fifth horizontally extending member coupled between the second pair of leg members, a sixth horizontally extending member coupled between the first one of the first pair of leg members and the first one of the second pair of leg members, a seventh horizontally extending member coupled between the second one of the first pair of leg members and the second one of the second pair of leg members; and an eighth horizontally extending member coupled between the sixth and seventh horizontally extending members at intermediate portions thereof;

a seating means aligned with and coupled to the upper support member for supporting a user's lower body thereon which includes, a rectangular shaped padded member aligned with and coupled to the pair of spaced horizontally extending members of the upper support member, a diagonally extending support member for supporting a user's chest and upper body thereon, a first elongated padded member coupled around the second horizontally extending member of the upper support member, and a second elongated padded member coupled around the third horizontally extending member of the upper support member;

means coupled to the diagonally extending support member and the upper support member for supporting the diagonally extending support member for movement to a plurality of predetermined diagonal position; and means coupled to the diagonally extending support member for stopping the diagonally extending support member in a predetermined lowermost diagonal position.

2. A gardening chair as defined in claim 1 wherein the diagonally extending support member includes an elongated planar shaped member.

3. A gardening chair as defined in claim 2 wherein the means for stopping the diagonally extending support member in a predetermined lowermost diagonal position includes:

a pair of horizontally extending support members coupled to an underside of the elongated planar shaped member; and an elongated member coupled to the pair of spaced horizontally extending support members so that when the planar member is moved downwardly to a predetermined diagonal position the elongated member engages the first horizontally extending member of the upper support member thereby stopping further downward motion of the planar shaped member.

4. A gardening chair as defined in claim 3 wherein the means for supporting the diagonally extending support member for the movement to a plurality of predetermined positions includes:

a tensioning arm having first portions thereof coupled to an intermediate lower portion of the elongated planar shaped member; and an elastic band having first portions thereof coupled to a second portion of the tensioning arm and a second portion thereof coupled to an intermediate portion of the first horizontally extending member between the first pair of leg members.

* * * * *